US011365556B1

(12) United States Patent
Anderson et al.

(10) Patent No.: US 11,365,556 B1
(45) Date of Patent: Jun. 21, 2022

(54) SYSTEMS AND METHODS FOR SUPPORTING UTILITY POLES

(71) Applicant: Complete Utility Contracting Ltd., Langley (CA)

(72) Inventors: Steven Paul Anderson, Langley (CA); Adam Christopher Matheos, Langley (CA)

(73) Assignee: Complete Utility Contracting Ltd., Langley (CA)

( * ) Notice: Subject to any disclaimer, the term of this patent is extended or adjusted under 35 U.S.C. 154(b) by 0 days.

(21) Appl. No.: 17/376,023

(22) Filed: Jul. 14, 2021

(51) Int. Cl.

| | |
|---|---|
| ***E04H 12/20*** | (2006.01) |
| ***E04H 12/34*** | (2006.01) |
| ***H01Q 1/12*** | (2006.01) |
| ***E04G 21/26*** | (2006.01) |

(52) U.S. Cl.
CPC ..... *E04H 12/20* (2013.01); *E04G 21/26* (2013.01); *E04H 12/347* (2013.01); *H01Q 1/1235* (2013.01)

(58) Field of Classification Search
CPC ... E04B 2002/8688; E04C 3/30; E02D 27/42; E04G 17/14; E04G 21/26; E04H 12/20; E04H 12/2253; E04H 12/347; H01Q 1/1235
See application file for complete search history.

(56) References Cited

U.S. PATENT DOCUMENTS

| | | | | |
|---|---|---|---|---|
| 3,817,006 A * | 6/1974 | Williams | E04G 21/26 | 52/127.2 |
| 4,068,427 A | 1/1978 | Camardo | | |
| 4,996,770 A * | 3/1991 | McCracken | E04G 17/14 | 248/357 |
| 5,076,536 A * | 12/1991 | Fitzgerald | E04G 17/04 | 249/219.1 |
| 5,573,237 A * | 11/1996 | Van Nimwegen | A63B 63/083 | 248/161 |
| 5,817,247 A * | 10/1998 | Colatruglio | E01C 19/502 | 249/4 |
| 5,843,327 A * | 12/1998 | Lindgren | E04G 17/14 | 249/210 |
| 6,655,097 B1 | 12/2003 | Poolaw | | |
| 8,028,476 B1 * | 10/2011 | Alford | E04H 4/0043 | 52/126.4 |
| 9,739,070 B2 * | 8/2017 | Bushore | E04C 3/30 | |
| 10,450,764 B2 * | 10/2019 | Woodford | E04G 23/04 | |

(Continued)

FOREIGN PATENT DOCUMENTS

| | | | |
|---|---|---|---|
| CA | 2805515 A1 * | 9/2013 | E02D 27/42 |
| CN | 104652911 A | 5/2015 | |

(Continued)

*Primary Examiner* — Jessie T Fonseca

(74) *Attorney, Agent, or Firm* — Todd A. Rattray; Oyen Wiggs Green & Mutala LLP

(57) ABSTRACT

A pole support system provides temporary support to a utility pole and comprises: a bracing element positioned adjacent to, and elongated in the direction of elongation of, the utility pole and securable to the utility pole; a ballast support frame comprising a base, positionable at a location spaced horizontally apart from the utility pole; mass positionable on, and removable from, the base of the ballast support frame; and a support system comprising one or more arms extending between the bracing element and the ballast support frame.

19 Claims, 8 Drawing Sheets

(56) References Cited

U.S. PATENT DOCUMENTS

| | | | | |
|---|---|---|---|---|
| 10,634,122 | B1 | 4/2020 | Clifton et al. | |
| 2002/0073634 | A1* | 6/2002 | Bolinger | E04G 21/26 52/127.2 |
| 2003/0076273 | A1* | 4/2003 | Cockell | H01Q 1/1207 343/878 |
| 2003/0190196 | A1* | 10/2003 | Lanka | E04G 21/26 405/272 |
| 2005/0072059 | A1* | 4/2005 | Hodsdon | E04G 21/26 52/64 |
| 2006/0194653 | A1* | 8/2006 | Nye | A63B 63/083 473/479 |
| 2006/0201743 | A1* | 9/2006 | Dell'Erba | E04G 17/14 182/82 |
| 2006/0248849 | A1* | 11/2006 | Hall | E04G 21/3238 52/741.15 |
| 2008/0202043 | A1* | 8/2008 | Marshall | E04G 21/26 52/127.2 |
| 2017/0214116 | A1* | 7/2017 | Bustos | H01Q 1/1228 |
| 2018/0073259 | A1* | 3/2018 | Johnson | E04G 17/14 |
| 2018/0298625 | A1* | 10/2018 | White | E04G 13/00 |
| 2019/0055750 | A1 | 2/2019 | Harmer | |

FOREIGN PATENT DOCUMENTS

| | | | | | |
|---|---|---|---|---|---|
| EP | 1003238 | A1 | | 5/2000 | |
| GB | 2406105 | A | * | 3/2005 | E01F 13/022 |
| GB | 2508263 | A | * | 5/2014 | E04G 17/14 |
| KR | 100878486 | B1 | | 1/2009 | |
| KR | 20110116397 | A | * | 10/2011 | |
| WO | WO-9417867 | A1 | * | 8/1994 | A63B 71/023 |
| WO | WO-02095223 | A1 | * | 11/2002 | F03D 13/25 |

* cited by examiner

SYSTEMS AND METHODS FOR SUPPORTING UTILITY POLES

FIELD

This invention relates to supporting utility poles. This invention may be embodied, for example, in systems and methods for supporting utility poles. This invention may particularly have application in supporting utility poles where there is an excavation in the vicinity of the particular utility pole.

BACKGROUND

In some jurisdictions there are regulatory requirements relating to providing support to a utility pole while excavation occurs in its vicinity. British Columbia, Canada, is an example of a jurisdiction that has some such regulations. In British Columbia it is required that utility poles be supported if the surrounding soil is not firm or if the excavation takes place within an area surrounding the utility pole, the area for which support is required being dependent on the utility pole's diameter.

Current systems for providing temporary support to a utility pole require the presence of a truck temporarily supporting the utility pole. Such systems are expensive and may require the supervision of a third party engineer.

There is a general need and a desire for temporary pole support systems that require less equipment, expense and human supervision.

SUMMARY

This invention has a number of aspects. These include, without limitation:

- systems for supporting utility poles;
- methods for supporting utility poles;
- ballast support frames for supporting utility poles;
- cantilevered support frames for supporting utility poles; and
- bracing elements for supporting utility poles.

One aspect of the invention provides a pole support system, for providing temporary support to a utility pole that is elongated in a generally vertical direction. The pole support system comprises: a bracing element positioned adjacent to, and elongated in the direction of elongation of, the utility pole and securable to the utility pole; a ballast support frame comprising a base, positionable at a location spaced horizontally apart from the utility pole; mass positionable on, and removable from, the base of the ballast support frame; and a support system comprising one or more arms extending between the bracing element and the ballast support frame.

The bracing element may comprise a hollow or solid core. The bracing element may comprise a steel hollow structural section column.

The bracing element may comprise a pole-contacting surface having a shape that is complimentary to a shape of the utility pole, to facilitate abutting engagement between the pole-contacting surface and the utility pole when the bracing element is secured to the utility pole.

The bracing element may comprise a pole-contacting surface having a concave shape that is complimentary to a convex shape of the utility pole to facilitate abutting engagement between the pole-contacting surface and the utility pole when the bracing element is secured to the utility pole.

The ballast support frame may comprise a vertical member that extends upwardly from the base and one or more ballast support braces that extend diagonally between the base and one or more locations on the vertical member that are spaced apart from the base.

The one or more locations on the vertical member that are spaced apart from the base may be at a top of the vertical member.

The base may be generally horizontally oriented.

The base may comprise a plurality of hollow structural sections. at least two of the hollow structural sections may be spaced apart in a manner to be able to engage with the forks of a forklift.

The mass may comprise one or more interlocking blocks. The interlocking blocks may comprise concrete interlocking blocks.

The one or more arms may comprise a plurality of parallel arms spaced vertically apart from one another.

The one or more arms may comprise a plurality of parallel arms spaced vertically apart from one another and the plurality of parallel arms may attach to the vertical member of the ballast support frame.

The one or more arms may be extendible in directions along their extensions between the ballast support frame and the utility pole.

The one or more arms may be removably attached to one or both of the bracing element and the ballast support frame.

The one or more arms may be hingedly attached to the bracing element to permit relative pivotal movement between the one or more arms and the bracing element about one or more corresponding arm-bracing element horizontal axes.

The one or more arms may be hingedly attached to the ballast support frame to permit relative pivotal movement between the one or more arms and the ballast support frame about one or more corresponding arm-ballast support horizontal axes.

Simultaneous relative pivotal movement between the one or more arms and the bracing element about one or more corresponding arm-bracing element horizontal axes and between the one or more arms and the ballast support frame about one or more corresponding arm-ballast support frame horizontal axes may permit adjustment of a vertical location of the bracing element relative to a vertical location of the ballast support frame.

The one or more arms may comprise a plurality of arms and the support frame may comprise one or more support braces extending diagonally between the plurality of arms.

Each of the one or more support braces may be attached to at least one of the plurality of arms at a location that is adjustable along a direction of extension of the at least one of the plurality of arms.

The at least one of the plurality of arms may comprise a slot that extends along the direction of extension of the at least one of the plurality to arms to facilitate attachment of a support brace at various locations along the slot. The slot may comprise a plurality of concavities that open in a direction orthogonal to the direction of the extension of the at least one of the plurality of arms.

The at least one of the plurality of arms may comprise a plurality of apertures at various locations along the direction of extension of the at least one of the plurality to arms to facilitate attachment of a support brace at any one of the various locations.

The one or more arms may comprise a plurality of arms, the support frame may comprise one or more support braces that extend diagonally between the plurality of arms and each of the one or more support braces may be attached to at least one of the plurality of arms at a location that is adjustable along a direction of extension of the at least one of the plurality of arms.

A first support brace may span diagonally between a first and a second arm in one direction and a second support brace may span diagonally between the first and second arm in an opposite direction such that the first and second support braces form an X shape.

The first and second support braces may be pivotally coupled to one another to facilitate relative pivotal adjustment about a horizontal axis.

The pole support system may be used to support the utility pole during an excavation proximate to the utility pole.

The excavation may be generally elongated in a first horizontal y-direction and the pole support system may be located, about a generally vertical z-direction axis that is parallel with the generally vertical direction in which the utility pole is elongated, at an angle that is in a range of −45° to +45° or +135° to +225° relative to a generally horizontal x-direction that is orthogonal to both the y-direction and the z-direction.

The excavation may be generally elongated in a first horizontal y-direction and the pole support system may be located, about a generally vertical z-direction axis that is parallel with the generally vertical direction in which the utility pole is elongated, at an angle that is in a range of −20° to +20° or +160° to +200° relative to a generally horizontal x-direction that is orthogonal to both the y-direction and the z-direction.

Another aspect of the invention provides a method for providing temporary support to a utility pole that is elongated in a generally vertical direction. The method comprises: securing a bracing element that is elongated in the direction of elongation of the utility pole to the utility pole such that the bracing element is in contact with the utility pole; placing a ballast support frame at a location spaced horizontally apart from the utility pole; placing mass in the ballast support frame to act as a counter weight; and securing a support system comprising one or more arms between the bracing element and the ballast support frame.

The method may comprise leveling ground on which the ballast support frame is placed prior to placing the ballast support frame. Leveling the ground on which the ballast support frame is placed may comprise installing a gravel pad.

The method may comprise extending or retracting the one or more arms to adjust their lengths between the ballast support frame and the utility pole.

The one or more arms may be hingedly attached to the bracing element and the method may comprise effecting relative pivotal movement between the one or more arms and the bracing element about one or more corresponding arm-bracing element horizontal axes.

The one or more arms may be hingedly attached to the ballast support frame and the method may comprise effecting relative pivotal movement between the one or more arms and the ballast support frame about one or more corresponding arm-ballast support frame horizontal axes.

The method may comprise effecting simultaneous relative pivotal movement between the one or more arms and the bracing element about one or more corresponding arm-bracing element horizontal axes and between the one or more arms and the ballast support frame about one or more corresponding arm-ballast support horizontal axes to thereby adjust a vertical location of the bracing element relative to a vertical location of the ballast support frame Further aspects and example embodiments are illustrated in the accompanying drawings and/or described in the following description.

It is emphasized that the invention relates to all combinations and/or sub-combinations of the above features and the claims recited herein, even if these features are recited in different claims.

BRIEF DESCRIPTION OF THE DRAWINGS

The accompanying drawings illustrate non-limiting example embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

One aspect of the invention is a pole support system. Such pole support system may have applications in providing temporary support to utility poles (e.g. poles supporting electrical wires, street light poles and/or the like), particularly where excavation is occurring in the vicinity of the utility pole. Typically, the utility pole will be generally vertically oriented. The pole support system may comprises a pole brace element (bracing element) generally aligned with an extending in a direction parallel to the extension of the utility pole and made of a rigid material that is secured to the utility pole. The pole support system may further comprise a ballast support frame that is horizontally (e.g. radially) spaced apart from the utility pole. Placing the ballast support frame at a horizontal (e.g. radial) distance apart from the utility pole may increase the leverage (e.g. torque) of the ballast and may allow the pole support system to extend across excavated areas, for example, trenches. The ballast support frame may receive one or more masses which may act as a counterweight and/or an anchor for the pole support system. The pole support system may further comprise an adjustable support frame for attaching the bracing element to the ballast support frame. The support frame may be cantilevered above ground and may comprise hinged attachment to the brace element and/or to the ballast support frame to allow the support frame to pivot about one or more generally horizontally oriented axes to permit adjustment according to variations in the level of the ground surface.

Figure 1:
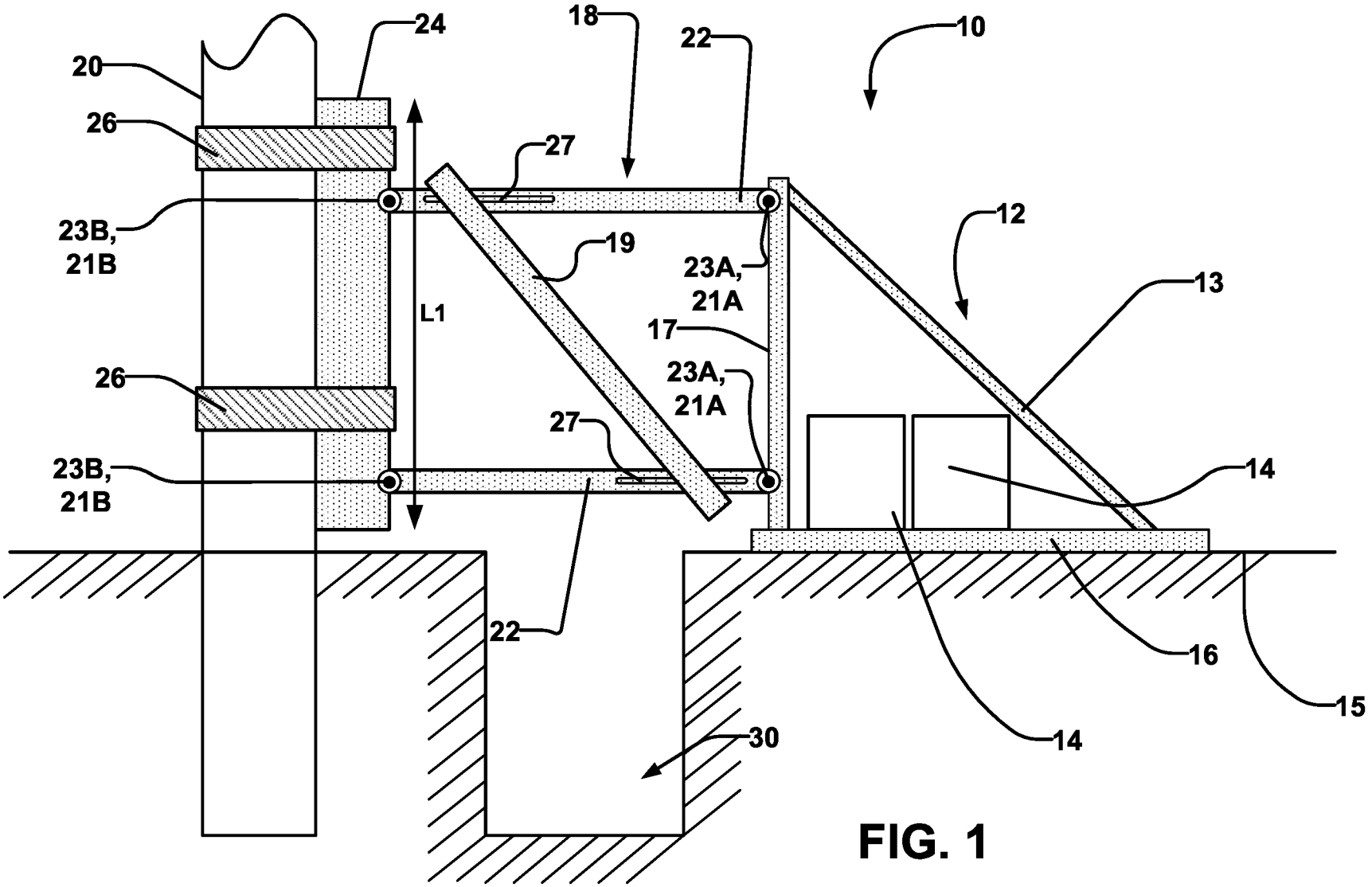
FIG. 1 is a side view of a temporary support system according to an example embodiment of the invention described herein placed on the same side as an excavation near the utility pole.

FIG. 1 depicts a side view of an example embodiment of temporary support system 10 providing temporary support to utility pole 20. Utility pole 20 protrudes substantially vertically from ground 15. Near utility pole 20 excavation has occurred in the form of trench 30. In some embodiments, trench 30 may have a depth of about 3.1 meters or less, although trench 30 may have depths outside of this range. Pole support system 10 has applications in providing temporary support to utility poles (e.g. pole 20) where excavation occurs near utility pole 20. In some applications, any excavation 30 (having at least approximately 1:1 (rise:run) edge-slope) that is located (in whole or in part) a horizontal distance from the outer perimeter of utility pole 20 at a distance of 4 times the diameter of utility pole 20 or less may be considered to be near utility pole 20. For example, if utility pole 20 has a diameter of 1 foot, an excavation 30 located (in whole or in part) within 4 feet or less horizontally from the outer perimeter of utility pole 20 may be considered to be nearby. In some applications, this "nearby" distance range is less than 8 times the diameter of utility pole 20. These "nearby" distance ranges may increase with depth of excavation 30 and/or if the rise:run edge slope is greater than 1:1. These nearby distance ranges are specific to the various codes in various jurisdictions and, unless specifically recited in the claims, are not a requirement for the use or operation of temporary support system 10. Pole support system 10 may be installed prior to digging of excavation 30.

Pole support system 10 comprises bracing element 24. Bracing element 24 is secured to utility pole 20 during use of pole support system 10. Bracing element 24 may be elongated in a direction that is generally parallel to the extension of utility pole 20. Typically, this direction of extension of utility pole 20 and bracing element 24 is generally vertical. Bracing element 24 may brace utility pole 20.

Bracing element 24 comprises a pillar like structure. The cross-sectional area, taken in a plane transverse to the longitudinal direction (denoted by L1) of bracing element 24 may be any one geometric shape or a combination of a plurality of geometric shapes. In some embodiments, bracing element 24 has a rectangular cross-section. In some circumstances, it can be desirable to have a surface area of contact between bracing element 24 and pole 20 that is relatively large. Bracing element 24 may comprise a pole-contacting surface 24A (FIG. 2) that has a concave radius of curvature (or a radius of curvature gradient) that matches the convex radius of curvature (or radius of curvature gradient) of utility pole 20 to maximize surface area of contact between bracing element 24 and pole 20. In some embodiments, pole-contacting surface 24A of bracing element 24 may be otherwise shaped to have a shape that is complementary to a corresponding shape of the surface of utility pole 20. In some such embodiments, bracing elements 24 having different pole-contacting surface 24A shapes may be swapped into and out of pole support system 10 for use with different shaped utility poles 20.

In some embodiments, the longitudinal direction of bracing element 24 (denoted by L1 in FIG. 1) may be equal to or greater than approximately ¼ the longitudinal direction (i.e. the height) of utility pole 20 above ground 15. In some embodiments, this longitudinal direction L1 of bracing element 24 is equal to or greater than ⅛ of the height of utility pole 20 above ground 15. In some embodiments, this longitudinal direction L1 of bracing element 24 is equal to or greater than 1/16 of the height of utility pole 20 above ground 15. In some non-limiting embodiments, bracing element 24 may have a longitudinal dimension L1 in a range of 36-180 inches. In some non-limiting embodiments, the cross-sectional area of bracing element 24 may be in a range of 12-125 square inches.

Bracing element 24 is made of a rigid material. Suitable rigid materials include, without limitation, one or both of steel and wood. In some embodiments, bracing element 24 is made of steel. In some embodiments bracing element 24 comprises a steel hollow structural section ("HSS") column.

In using pole support system 10, bracing element 24 is located adjacent to utility pole 20 such that the longitudinal direction (L1) of bracing element 24 is generally parallel to the longitudinal direction of utility pole 20. Bracing element 24 may be placed in abutting contact with utility pole 20. Bracing element 24 may or may not be in contact with ground 15. The support provided by pole support system 10 to utility pole 20 may increase the closer to ground 15 bracing element 24 is positioned. In some embodiments bracing element 24 may be positioned 6 inches above ground 15.

Bracing element 24 is secured to utility pole 20 with one or a plurality of straps 26. Strap(s) 26 may be flexible so that they are positionable around the outer perimeter of the combined utility pole 20 and bracing element 24 (see e.g. FIG. 2). Straps 26 are positioned to form a snug fit around the outer perimeter of bracing element 24 and utility pole 20. One or more ratcheting closures and/or the like may be located on straps 26. Ratcheting closures and/or the like may aid to create a snug fit of straps 26 around the outer perimeter of utility pole 20 and bracing element 24, so that bracing element 24 is in abutting contact with utility pole 20. Such ratcheting closures and/or the like may have a locking functionality. In some embodiments, straps 26 may be made of polyester, long-elongations, lifting straps with a working load limit of 5400 lbs, although other working load limits are possible. It is advantageous for straps 26 to be free of rips, tears, or other signs of wear.

In some embodiments two or more straps 26 are used to secure bracing element 24 and utility pole 20. A first strap 26 may be positioned near the top of bracing element 24. The first strap 26 may be positioned within 1 foot from the top of bracing element 24. A second strap 26 may be positioned near the bottom of bracing element 24. The second strap 26 may be positioned in a region from 4 inches above the bottom of bracing element 24 to 1 foot above the bottom of bracing element 24.

Pole support system 10 further comprises a cantilevered support frame 18. Cantilevered support frame 18 may be positioned above ground 15. The positioning of cantilevered support frame 18 above ground 15 in part allows for excavation 30 near utility pole 20 to occur after pole support system 10 has been set up.

Cantilevered support frame 18 comprises one or a plurality of arms 22—two arms 22 located vertically above one another are shown in the illustrated embodiment of FIG. 1. Arms 22 are positioned between bracing element 24 and ballast support frame 12. Arms 22 may run substantially parallel with the ground (e.g. horizontally) and/or substantially perpendicular with one or both of utility pole 20 and/or bracing element 24, although, as discussed below, arms 22 may be hinged to permit arms 22 to adjust to have non-horizontal extension. Arms 22 may be substantially parallel to, and vertically spaced apart from, each other, although this is not necessary. Arms 22 may be aligned with one another in a vertical plane (see e.g. FIGS. 1 and 2).

In some embodiments cantilevered support frame 18 comprises two arms 22. In such embodiments arms 22 may be positioned to approximately form a rectangle (or parallelogram) between bracing element 24, arms 22 and ballast support frame 12 (see e.g. FIG. 1). A first arm 22 may be positioned approximately near the top of ballast support frame 12 and/or bracing element 24. The first arm 22 may be positioned within 2 feet (e.g. approximately 1 foot) below the top of bracing element 24. A second arm 22 may be positioned approximately near the bottom of ballast support frame 12 and/or bracing element 24. The second arm 22 may be positioned within 1 foot (e.g. approximately 2 inches) above the bottom of bracing element 24.

Arms 22 may be attached to ballast support frame 12 and/or bracing element 24. In some embodiments, arms 22 may be rigidly attached to ballast support frame 12 and/or bracing element 24. In some embodiments, arms 22 may be removably attached to ballast support frame 12 and/or bracing element 24.

In some embodiments, arms 22 may be attached at one of their ends to ballast support frame 12 by hinges 23A which facilitate relative pivotal movement between arms 22 and ballast support frame 12 about corresponding generally horizontal axes 21A. In some embodiments, arms 22 may be attached at their opposing ends to bracing element 24 by hinges 23B which facilitate relatively pivotal movement between arms 22 and bracing element 24 about corresponding generally horizontal axes 21B. Generally horizontal axes 21A, 21B (together axes 21) may extend into and out of the page in the illustrated view of FIGS. 1 and 1A. Hinges 23A, 23B (collectively hinges 23) may comprise any suitable hinge design or pivot joint design. In currently preferred embodiments, hinges 23 comprise lockable hinges 23, which are lockable at one or more discrete angular orientations around their respective axes 21 to prevent further relative angular movement about their respective hinges. In some embodiments, each of hinges 23 may be located at one of a number of suitable locations along the extension of arms 22, so that the length of arms 22 between hinges 23A, 23B is adjustable.

Figure 1A:
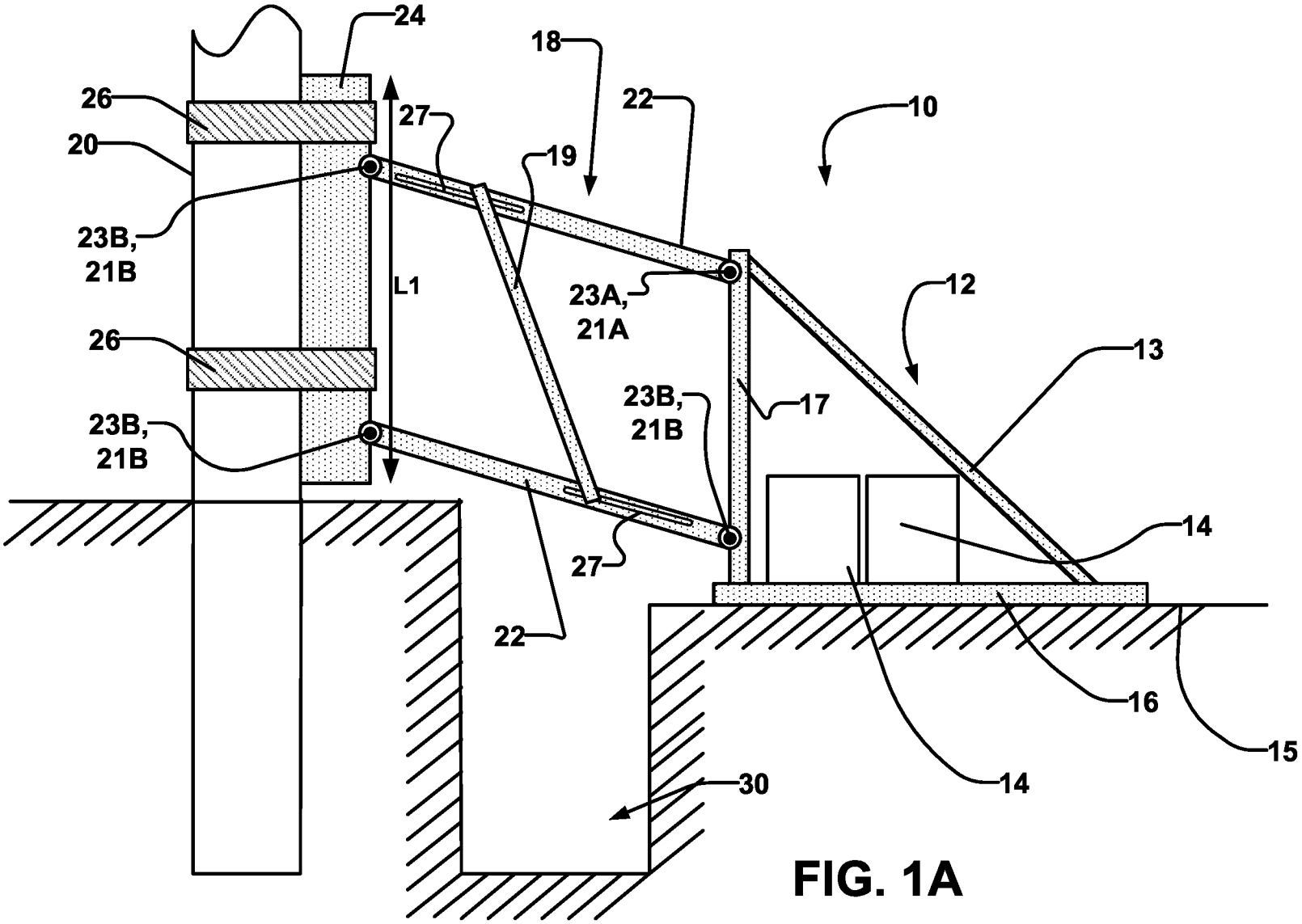
FIG. 1A is a side view of the example temporary support system of FIG. 1 in an example configuration.
Figure 1B:
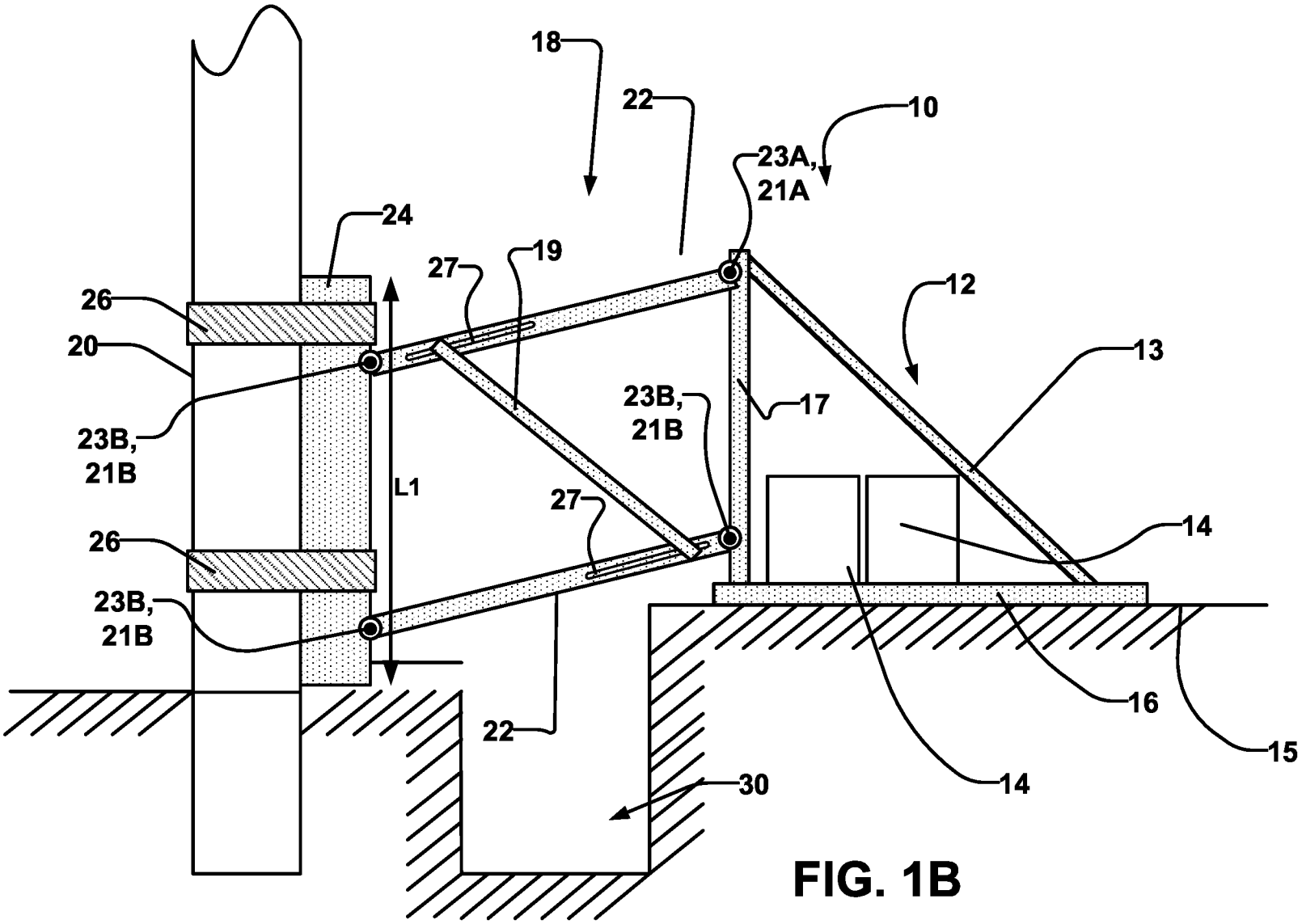
FIG. 1B is a side view of the example temporary support system of FIG. 1 in another example configuration.

As can be seed by comparing FIGS. 1, 1A and 1B, relative pivotal movement of hinges 23A about axes 21A and hinges 23B about axes 21B permits relative vertical adjustment between ballast support frame 12 and bracing element 24. When arms 22 are pivoted in this manner and, as can be seen from FIGS. 1A and 1B, it will be appreciated that arms 22 may be positioned to approximately form a parallelogram between bracing element 24, arms 22 and ballast support frame 12.

Figure 1C:
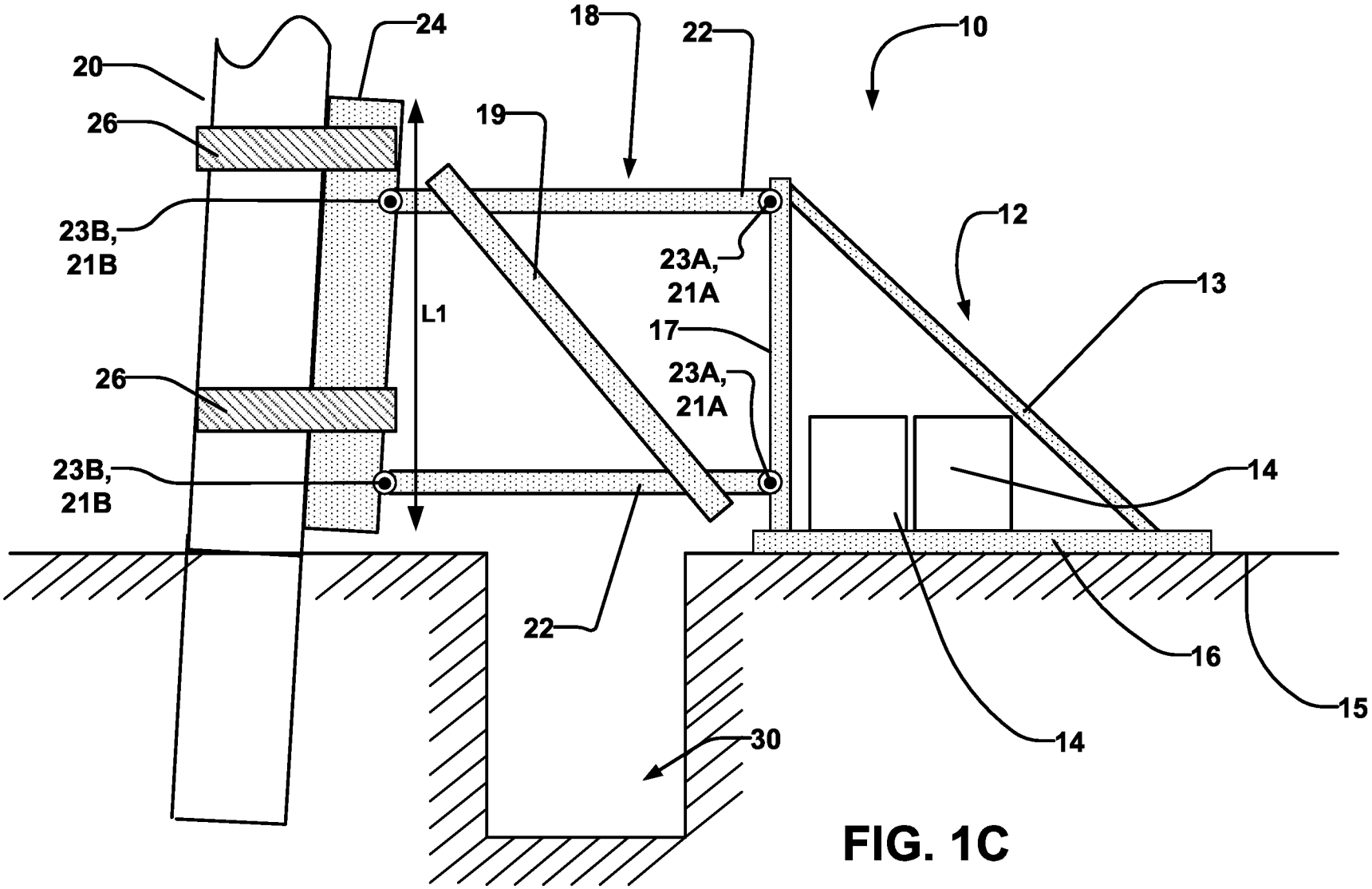
FIG. 1C is a side view of the example temporary support system of FIG. 1 in another example configuration.

Further, relative pivotal pivotal movement of hinges 23A about axes 21A and/or hinges 23B about axis 21B together with possible adjustment of the locations of one or more hinges 23 along arms 22 (and/or extension of arms 22) may permit pole support system 10 to accommodate utility poles 20 that are not vertically oriented as shown, for example, in FIG. 1C.

As discussed above, hinges 23 may be lockable to that the relative angular orientations of arms 22 relative to ballast support frame 12 (about axes 21A) and the relative angular orientations of arms 22 relative to bracing element 24 (about axes 21B) may be locked and fixed. This locking functionality may be facilitated by one or more locking mechanisms (not expressly shown) which may permit angular adjustment of these elements at one or more discrete angular orientations. Such locking functionality may be provided, by way of non-limiting example, by suitable locking clutches or by a pin extending parallel to, and spaced apart from, the corresponding axis which is removably insertable between angularly spaced apart holes a pair of disks (one disk located on each element of the hinge 23).

One or more arms 22 may be able to extend or retract along its direction of elongation. For example, each of arms 22 may comprise one inner arm member that telescopically slides within a bore of a second outer arm member. As another example, each of arms 22 may comprise a pair of U-channel cross-sectioned arm members that facilitate telescopic adjustment relative to one another. Such telescopic length adjustment of arms 22 may be locked in position using one or more pins that extend through one or more apertures in both of the arm members (e.g. in both the inner and outer arm members or in both the U-channel cross-sectioned arm members).

Arms 22 are made of a rigid material. Examples of rigid materials include one or both of steel and wood. In some embodiments arms 22 are made of steel.

Arms 22 may be strengthened and/or reinforced by one or more support brace(s) 19 extending between, and attached to, arms 22. Support brace(s) 19 may aid to prevent twisting between arms 22. Support brace(s) 19 may be made of the same material as arms 22. Support brace(s) 19 may run diagonally between the plurality of arms 22. Support brace(s) 19 may be pivotally connected to arms 22, so that support brace(s) 19 can pivot relative to arms 22 about generally horizontal pivot axes that may be parallel to the axes 21 of hinges 23 by which arms 22 are hinged to bracing element 24 and ballast support frame 12. In some embodiments support frame 18 comprises two arms 22 and one support brace 19. In such embodiments support brace 19 may run diagonally from a first arm 22 to a second arm 22. In some embodiments cantilevered support frame comprises two or more arms 22 and two or more support braces 19. In some such embodiments support braces 19 may run parallel to one another. In some such embodiments, a pair of support braces 19 may run diagonally between arms 22 in opposite directions in an "X" shape. In such embodiments the pair of support braces 19 may be pivotally coupled to one another to facilitate relative pivotal adjustment about a horizontal axis.

Figure 1D:
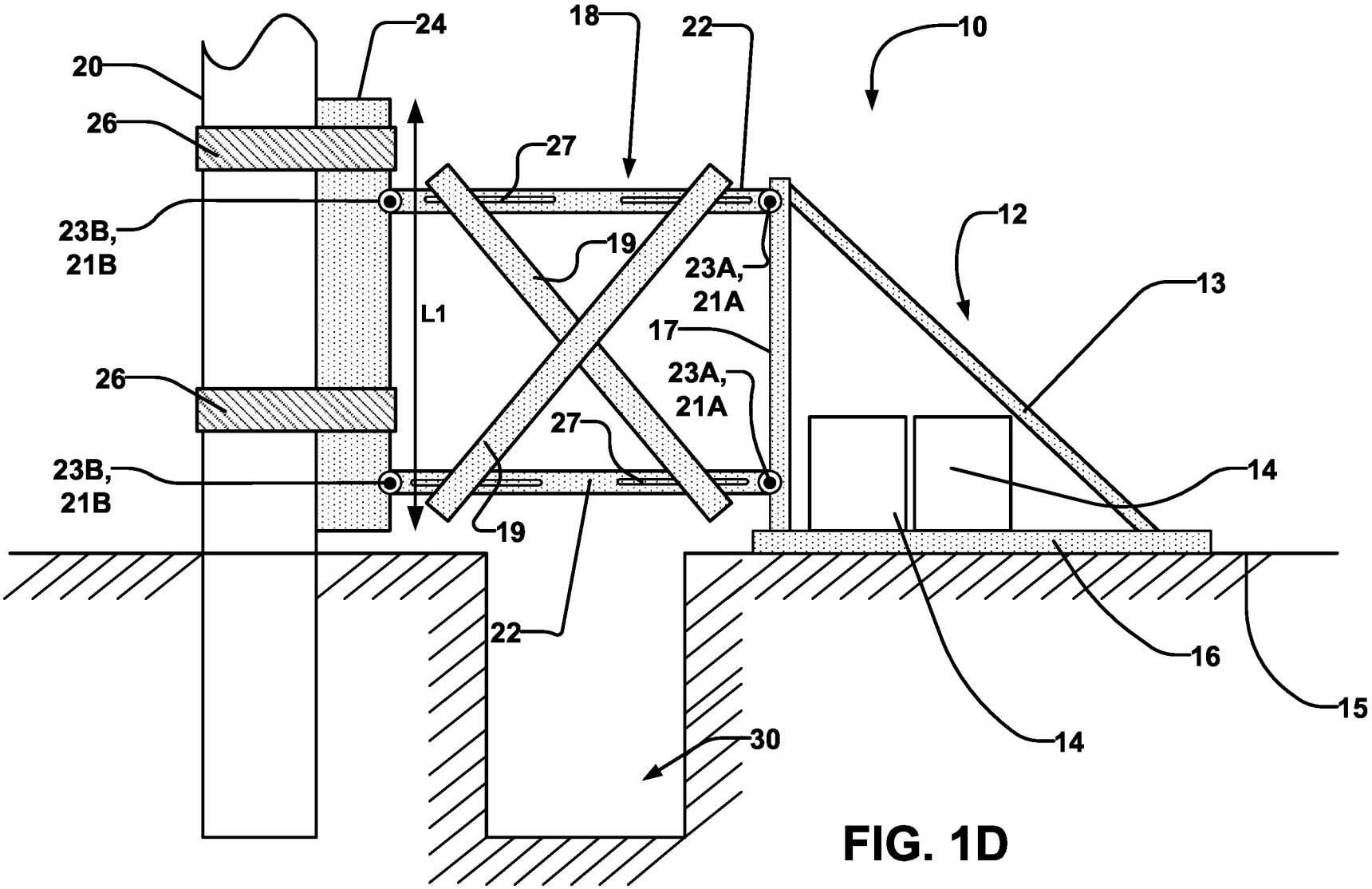
FIG. 1D is side view of a temporary support system according to a different example embodiment of the invention with its first and second support braces forming an X shape and wherein the first and second support braces are pivotally coupled to one another to facilitate relative pivotal adjustment about a horizontal axis.

The locations that support brace 19 attaches to arms 22 may be adjustable along the direction of elongation of arms 22. In some embodiments, the locations that support brace 19 attaches to arms 22 may be adjustable between a number of discrete locations along the direction of extension of arms 22. For example, arms 22 may be penetrated by a number of apertures (not shown) along their lengths and each of these apertures may accommodate an attachment of support brace 19 (e.g. with a suitable locking pin). In some embodiments, the locations that support brace 19 attaches to arms 22 may be slidable along suitable slots 27 (see FIGS. 1, 1A, 1B) that extend in the directions of elongation of arms 22. When adjusted to suitable locations, support braces 19 may be locked to suitable locations in such slots 27 by suitable locking mechanisms (not expressly shown). In some embodiments, slots 27 comprise a number of discrete concavities (that open in directions orthogonal to the direction of extension of arms 22) at various locations along the lengths of arms 22 to facilitate attachment of support brace 19. FIG. 1D is side view of a temporary support system according to a different example embodiment of the invention. The FIG. 1D support system has its first and second support braces 19 shaped to form an X shape and wherein the first and second support braces 19 are pivotally coupled to one another to facilitate relative pivotal adjustment about a horizontal axis.

Pole support system 10 also comprises ballast support frame 12. Ballast support frame 12 receives mass 14 and in turn provides the torque that supports utility pole 20. The design of ballast support frame 12 may vary between embodiments. The design of ballast support frame 12 is preferably robust enough to support the load torques applied to it by utility pole 20 and mass 14.

Ballast support frame 12 of the illustrated embodiment comprises base 16. Base 16 may comprise a plurality of hollow structural sections. A first and a second hollow structural section may be spaced to allow the forks of a fork lift to engage with the inner hollow section of the first and second hollow structural section. Ballast support frame 12 may be positioned at a distance away from the outer perimeter of utility pole 20. This distance may be in a range of 2-10 feet in some embodiments. This distance may depend on the length and/or orientations of arms 22. The top view of base 16 may be approximately rectangular (see e.g. FIG. 2), although this is not necessary.

Ballast support frame 12 receives mass 14 (e.g. one or more blocks or interlocking blocks 14). Ballast support frame 12 may receive the one or more interlocking block(s) 14 on base 16. The one or more interlocking block(s) 14 may provide force (torque) to counter the force (torque) associated with the mass of utility pole 20. Such force may be a result of the mass of interlocking blocks 14. The total mass of all interlocking blocks 14 may be sufficient to counter movement of utility pole 20. Interlocking blocks 14 may be added or removed as needed to sufficiently counter movement of utility pole 20. Prior to setting up pole support system 10, an engineer may determine the desired type and quantity of interlocking blocks 14 to sufficiently counter movement of utility pole 20. The ability to add or remove interlocking blocks 14 as needed may advantageously provide an adaptable pole support system 10 that can be altered as required on site. Interlocking blocks 14 may be made of any material. For example, interlocking blocks 14 may comprise concrete interlocking blocks. An interlocking block 14 may have dimensions of approximately 0.75 m by 0.75 m by 1.5 m (or 2.5 ft by 2.5 ft by 5 ft). Interlocking blocks 14 may be interlocking. In some embodiments interlocking blocks 14 may be type I or type 11. In some embodiments, mass 14 can be provided by other forms of heavy objects (other than interlocking blocks).

Ballast support frame 12 may further comprise vertical member 17. Vertical member 17 may attach to base 16. Vertical member 17 may be located near an end of base 16 that is closest to utility pole 22. Base 16 and vertical member 17 may approximately form an "L" shape—that is base 16 and vertical member 17 may extend in orthogonal directions. In some embodiments, vertical member 17 may run along the depth of base 16 with a depth equal to or less than the depth of base 16 (denoted by D1 in FIG. 2). In some embodiments, vertical member 17 may comprise a plurality of vertical masts spaced apart from one another along the depth of base 16 (denoted by D1 in FIG. 2). Vertical member 17 may be oriented substantially perpendicular to base 16. Vertical member 17 may be substantially parallel with one or both of bracing element 24 and utility pole 20. Arms 22 may attach to vertical member 17. In some embodiments, arms are hinged to vertical member 17 for relative pivotal movement about generally horizontal axes as discussed above. In some embodiments an arm 22 may attach approximately near the top of vertical member 17 and another arm 22 may attach approximately near the bottom of vertical member 17.

Ballast support frame 12 may further comprise one or more ballast support braces 13. One or more Ballast support brace(s) 13 may run diagonally between vertical member 17 and base 16. One or more ballast support brace(s) 13 may run from approximately near the top of vertical member 17 to base 16. Ballast support brace(s) 13 may provide additional support to ballast support frame 12. Ballast support brace(s) 13 may have a cross-sectional area that is any one geometric shape or any combination of geometric shapes. For example, the cross-sectional area of ballast support brace(s) 13 may be one or more of circular, ovular, annular, square and rectangular.

Ballast support frame 12 is placed on ground 15. In some embodiments ground 15 is level where ballast support frame 12 is placed. In some embodiments ground 15 is not level where ballast support frame 12 is to be placed. Ground 15 may be levelled prior to placing ballast support frame 12. For example, ground 15 may be levelled by installing a gravel pad prior to placing ballast support frame 12. In currently preferred embodiments, interlocking blocks 14 are placed on level ground.

Figure 2:
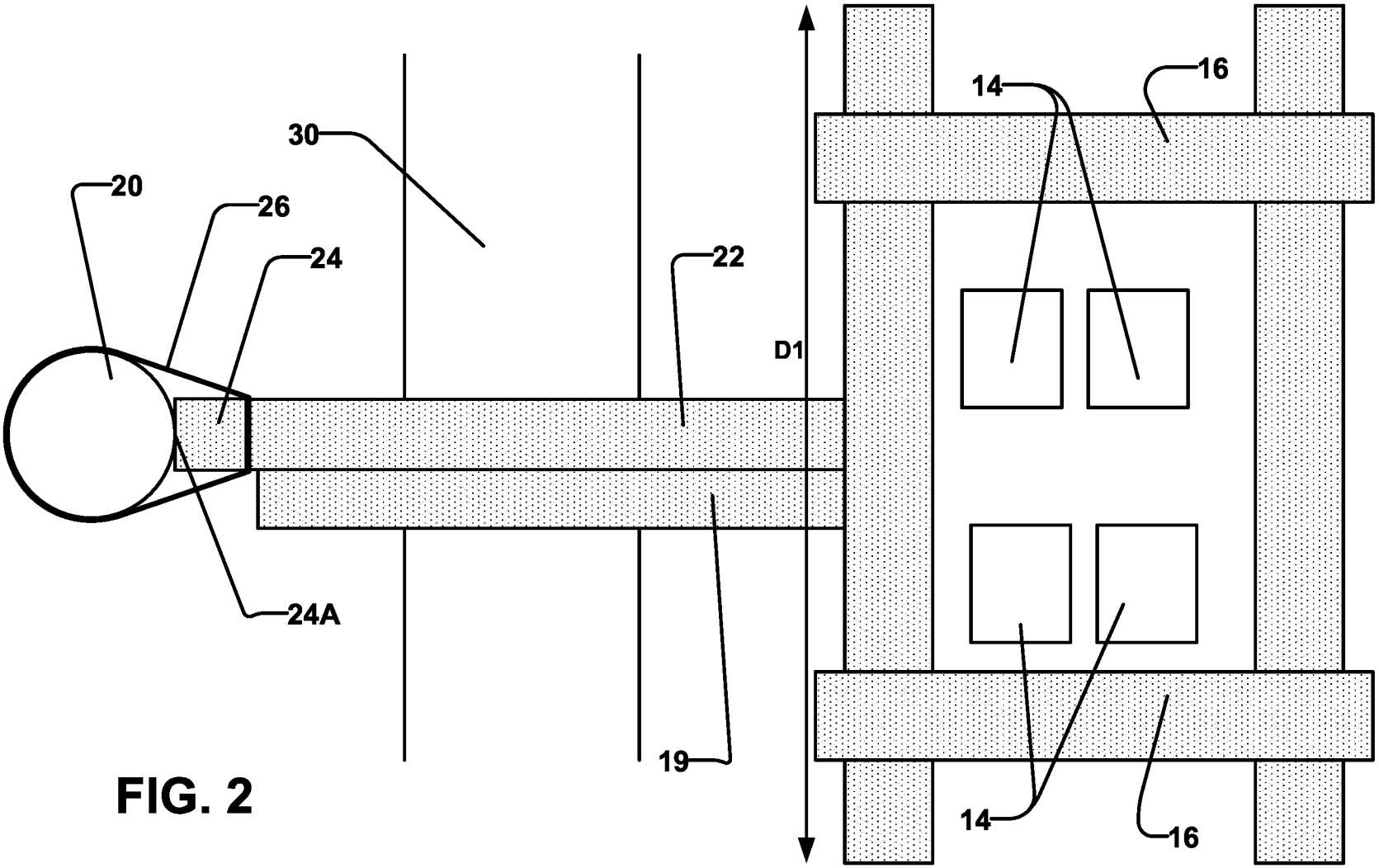
FIG. 2 is a top view of the example temporary support system of FIG. 1.

FIG. 2 depicts a top view schematic of pole support system 10 depicted in FIG. 1.

Figure 3:
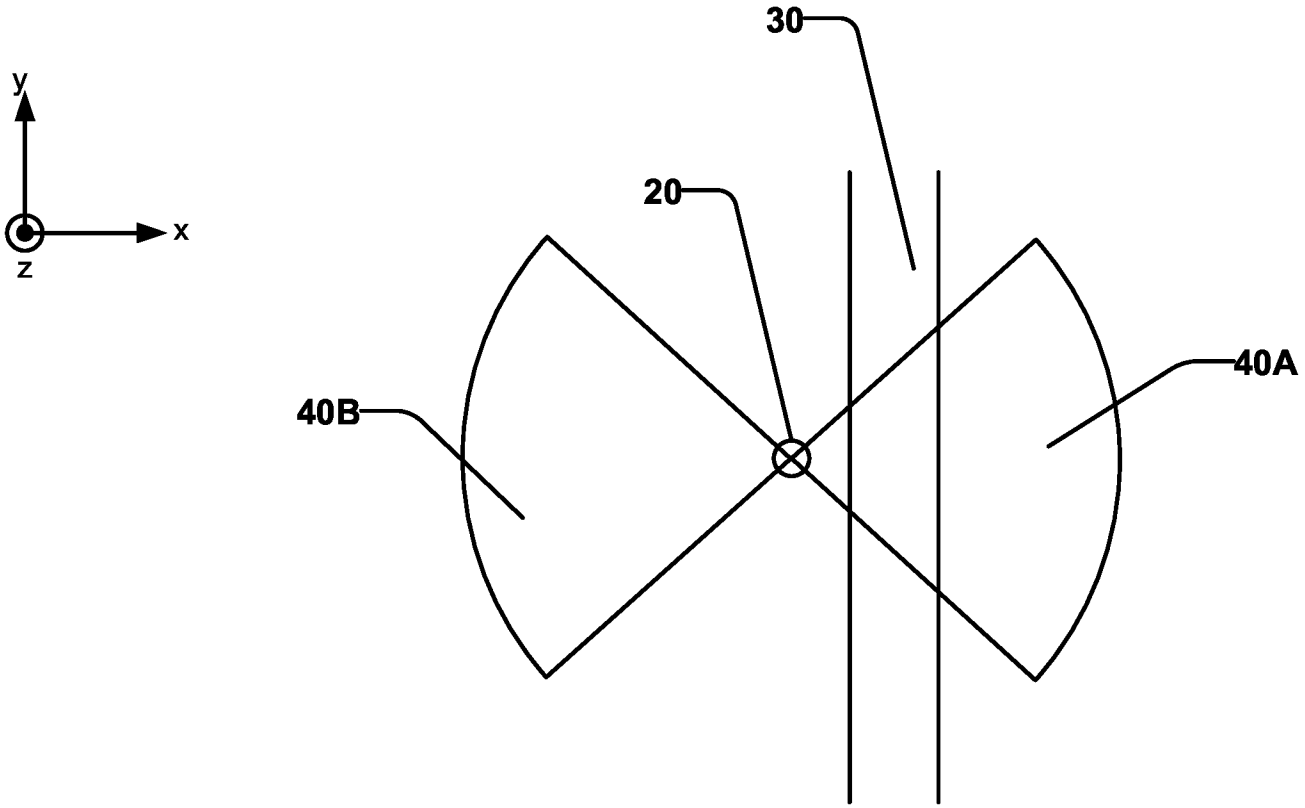
FIG. 3 is a top view depicting example acceptable positions for temporary support systems.

FIG. 3 depicts a top view schematic of possible placements of pole support system 10. Pole support system 10 may be placed in region 40A or 40B (collectively region 40). Region 40 may be defined by splitting the top-view of utility pole 20 into quadrants (i.e. x-y quadrants) where the x-axis runs substantially perpendicular to a direction of extension of trench 30 and the origin is found approximately at the centre of utility pole 20. Region 40 may be defined by the regions within 45° of the defined x-axis about the z-axis (i.e. the regions between 0° and 45°, 135° and 180°, 180° and 225°, and 315° and 360°) from the defined x-axis about the z-axis, where the z-axis is the at least approximately vertical axis of the utility pole 20.

Figure 4:
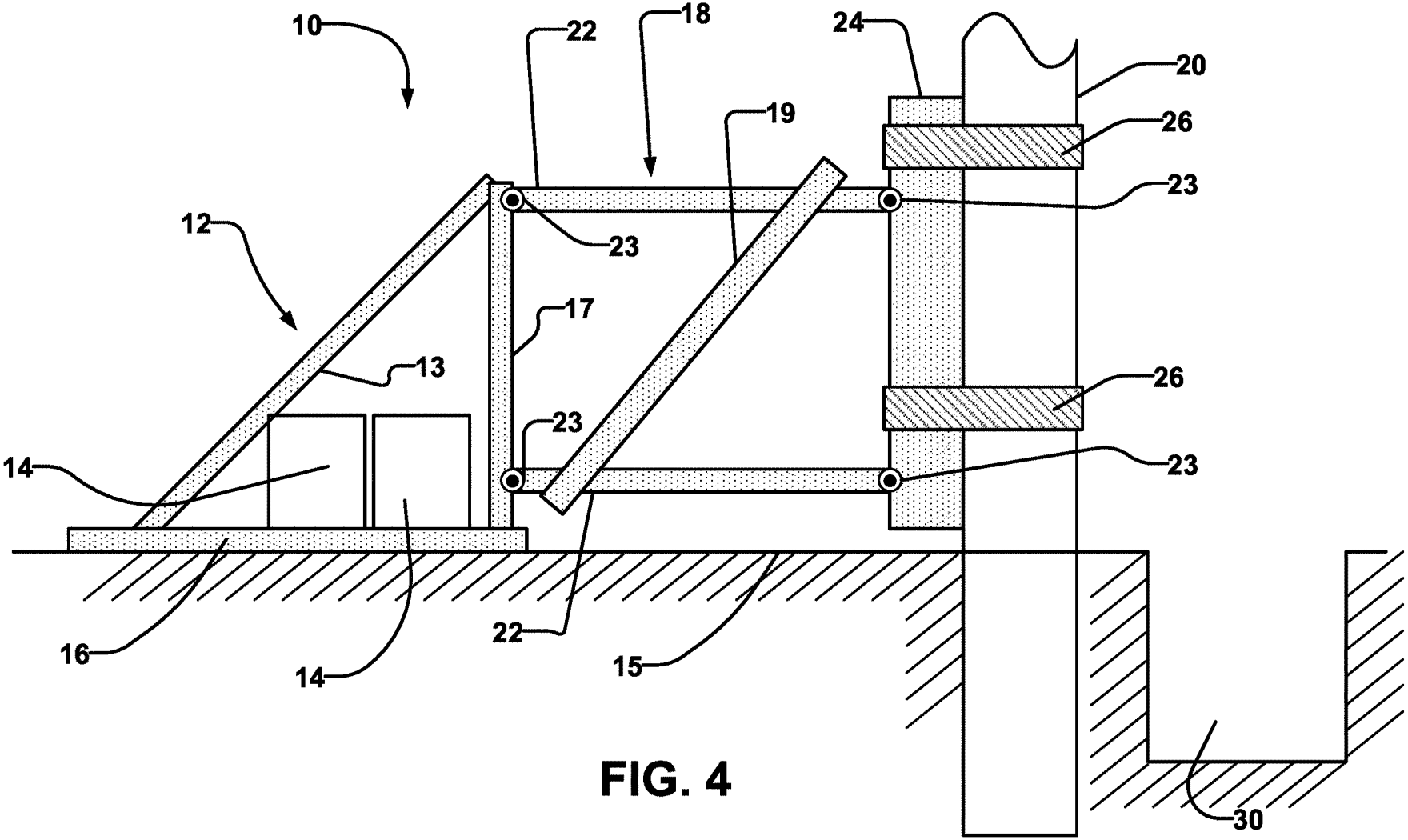
FIG. 4 is a schematic side view of the example temporary support system of FIG. 1 placed on the opposite side of an excavation near the utility pole.

Splitting the quadrants in terms of the y-axis the two quadrants on the same side as trench 30 may comprise region 40A and the two quadrants on the opposite side of trench 30 may comprise region 40B. Region 40A may be defined by the regions between 0° and 45° and 315° and 360°. Region 40B may be defined by the regions between 135° and 180° and 180° and 225°. FIG. 1 depicts an example embodiment of pole support system 10 placed in region 40A. FIG. 4 depicts a schematic of an embodiment of pole support system 10 with the same or similar features as depicted in FIG. 1 except that pole support system 10 is placed in region 40B.

In some embodiments region 40 may be defined by the regions within 20° of the x-axis about the z-axis (i.e. the regions between 0° and 20°, 160° and 180°, 180° and 200°, and 340° and 360°) from the defined x-axis about the z-axis, where the z-axis is the at least approximately vertical axis of the utility pole 20. In such embodiments, region 40A may be defined by the regions between 0° and 20° and 340° and 360°. Region 40B may be defined by the regions between 160° and 180° and 180° and 200°.

In some embodiments region 40 may be the region comprised from 0° to 360° around utility pole 20. The area that comprises region 40 may vary between embodiments. Such variance may result from circumstances in which pole support system 10 is being applied.

To set up pole support system 10 bracing element 24 may be secured to utility pole 20. A gravel pad may be installed to level ground 15 where ballast support frame 12 is to be placed. Ballast support frame 12 may be placed radially from utility pole 20 at a position within region 40. Ballast support frame 12 may be placed into position using a forklift. Interlocking blocks 14 may be placed within ballast support frame 12. Arms 22 may be attached to one or both of bracing element 24 and ballast support frame 12. Support brace(s) 19 may be secured. The order in which different components of pole support system 10 are set up may vary. For example, some components may be set up simultaneously. For example, ballast support frame 12 may be positioned prior to bracing element 24 being secured to utility pole 20. Excavation may occur when pole support system 10 is set up.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Where a component (e.g. a brace, support, system, assembly, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A pole support system, for providing temporary support to a utility pole that is elongated in a generally vertical direction, the pole support system comprising:

a bracing element comprising a pole-contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the ballast support frame comprises a vertical member that extends upwardly from the base and one or more ballast support braces that extend diagonally between the base and one or more locations on the vertical member that are spaced apart from the base.

2. The pole support system of claim 1 wherein the pole-contacting surface has a shape that is complimentary to a shape of the utility pole, to facilitate abutting engagement between the pole-contacting surface and the utility pole when the bracing element is secured to the utility pole.

3. The pole support system according to claim 1 wherein the mass comprises one or more interlocking blocks.

4. The pole support system according to claim 1 wherein the one or more arms are removably attached to one or both of the bracing element and the ballast support frame.

5. A pole support system, for providing temporary support to a utility pole that is elongated in a generally vertical direction, the pole support system comprising:

a bracing element comprising a pole-contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the pole-contacting surface has a concave shape that is complimentary to a convex shape of the utility pole to facilitate abutting engagement between the pole-contacting surface and the utility pole when the bracing element is secured to the utility pole.

6. A pole support system, for providing temporary support to a utility pole that is elongated in a generally vertical direction, the pole support system comprising:

a bracing element comprising a pole-contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the one or more arms comprise a plurality of parallel arms spaced vertically apart from one another.

7. A pole support system, for providing temporary support to a utility pole that is elongated in a generally vertical direction, the pole support system comprising:

a bracing element comprising a pole contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the one or more arms are extendible in directions along their extensions between the ballast support frame and the utility pole.

8. A pole support system, for providing temporary support to a utility pole that is elongated in a generally vertical direction, the pole support system comprising:

a bracing element comprising a pole-contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the one or more arms are hingedly attached to the bracing element to permit relative pivotal movement between the one or more arms and the bracing element about one or more corresponding arm-bracing element horizontal axes.

9. The pole support system according to claim 8 wherein:

the one or more arms are hingedly attached to the ballast support frame to permit relative pivotal movement between the one or more arms and the ballast support frame about one or more corresponding arm-ballast support horizontal axes; and simultaneous relative pivotal movement between the one or more arms and the bracing element about one or more corresponding arm-bracing element horizontal axes and between the one or more arms and the ballast support frame about one or more corresponding arm-ballast support frame horizontal axes permits adjustment of a vertical location of the bracing element relative to a vertical location of the ballast support frame.

10. The pole support system according to claim 9 wherein the one or more arms comprise a plurality of arms, the support frame comprises one or more support braces that extend diagonally between the plurality of arms and each of the one or more support braces is attached to at least one of the plurality of arms at a location that is adjustable along a direction of extension of the at least one of the plurality of arms.

11. The pole support system according to claim 10 wherein a first support brace spans diagonally between a first and a second arm in one direction and a second support brace spans diagonally between the first and second arm in an opposite direction such that the first and second support braces form an X shape and wherein the first and second support braces are pivotally coupled to one another to facilitate relative pivotal adjustment about a horizontal axis.

12. A pole support system, for providing temporary support to a utility pole that is elongated in a generally vertical direction, the pole support system comprising:

a bracing element comprising a pole-contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the one or more arms are hingedly attached to the ballast support frame to permit relative pivotal movement between the one or more arms and the ballast support frame about one or more corresponding arm-ballast support horizontal axes.

13. A pole support system, for providing temporary support to a utility pole that is elongated in a generally vertical direction, the pole support system comprising:

a bracing element comprising a pole-contacting surface, the bracing element positioned adjacent to, and elongated in the direction of elongation of, the utility pole and securable to the utility pole with the pole-contacting surface in contact with the utility pole;

a ballast support frame comprising a base, positionable at a location spaced horizontally apart from the utility pole;

mass positionable on, and removable from, the base of the ballast support frame; and a support system comprising one or more arms extending between the bracing element and the ballast support frame;

wherein the one or more arms comprise a plurality of arms and the support frame comprises one or more support braces extending diagonally between the plurality of arms.

14. The pole support system according to claim 13 wherein each of the one or more support braces is attached to at least one of the plurality of arms at a location that is adjustable along a direction of extension of the at least one of the plurality of arms.

15. A method for providing temporary support to a utility pole that is elongated in a generally vertical direction, the method comprising:

securing a bracing element that is elongated in the direction of elongation of the utility pole to the utility pole such that a pole-contacting surface of the bracing element is in contact with the utility pole;

placing a ballast support frame at a location spaced horizontally apart from the utility pole;

placing mass in the ballast support frame to act as a counter weight; and securing a support system comprising one or more arms between the bracing element and the ballast support frame.

16. The method according to claim 15 comprising leveling ground on which the ballast support frame is placed prior to placing the ballast support frame.

17. The method according to claim 15 wherein the one or more arms are hingedly attached to the bracing element and the method comprises effecting relative pivotal movement between the one or more arms and the bracing element about one or more corresponding arm-bracing element horizontal axes.

18. The method according to claim 15 wherein the one or more arms are hingedly attached to the ballast support frame and the method comprises effecting relative pivotal movement between the one or more arms and the ballast support frame about one or more corresponding arm-ballast support frame horizontal axes.

19. The method according to claim 15 wherein:

the one or more arms are hingedly attached to the bracing element to permit relative pivotal movement between the one or more arms and the bracing element about one or more corresponding arm-bracing element horizontal axes;

the one or more arms are hingedly attached to the ballast support frame to permit relative pivotal movement between the one or more arms and the ballast support frame about one or more corresponding arm-ballast support frame horizontal axes; and the method comprises:

effecting simultaneous relative pivotal movement between the one or more arms and the bracing element about one or more corresponding arm-bracing element horizontal axes and between the one or more arms and the ballast support frame about one or more corresponding arm-ballast support horizontal axes to thereby adjust a vertical location of the bracing element relative to a vertical location of the ballast support frame.

* * * * *